US012366029B2

(12) United States Patent
Leibman et al.

(10) Patent No.: US 12,366,029 B2
(45) Date of Patent: Jul. 22, 2025

(54) DRYER APPLIANCE AND FILTER APPARATUS

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); V V Anil Bhaskar Prasad Seereddy, Hyderabad (IN); Bobby Lee Lindsey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 794 days.

(21) Appl. No.: 17/529,442

(22) Filed: Nov. 18, 2021

(65) Prior Publication Data

US 2023/0151536 A1 May 18, 2023

(51) Int. Cl.

| | |
|---|---|
| ***D06F 58/22*** | (2006.01) |
| ***D06F 34/20*** | (2020.01) |
| ***D06F 34/28*** | (2020.01) |
| *D06F 103/40* | (2020.01) |
| *D06F 105/44* | (2020.01) |

(52) U.S. Cl.

CPC ..... *D06F 58/22* (2013.01); *D06F 34/20* (2020.02); *D06F 34/28* (2020.02); *D06F 2103/40* (2020.02); *D06F 2105/44* (2020.02)

(58) Field of Classification Search

None

See application file for complete search history.

(56) References Cited

U.S. PATENT DOCUMENTS

| | | | | |
|---|---|---|---|---|
| 2,434,886 A * | 1/1948 | Pugh | ..... | D06F 58/02 34/610 |
| 9,139,950 B2 | 9/2015 | Barrett | | |
| 9,920,469 B2 | 3/2018 | Ramprasad | | |
| 2012/0036730 A1 * | 2/2012 | Sans Rovira | ..... | D06F 58/20 34/85 |

FOREIGN PATENT DOCUMENTS

| | | | | |
|---|---|---|---|---|
| CN | 204447591 U | 7/2015 | | |
| EP | 2606172 B1 | 4/2014 | | |
| EP | 3117036 A1 | 1/2017 | | |
| EP | 3153804 A1 * | 4/2017 | ..... | F25D 25/025 |
| EP | 2508668 B1 | 6/2019 | | |
| JP | 2018511401 A | 4/2018 | | |
| KR | 101041904 B1 | 6/2011 | | |
| KR | 101177464 B1 | 8/2012 | | |
| KR | 101729557 B1 | 4/2017 | | |

* cited by examiner

*Primary Examiner* — Jason Lau

(74) *Attorney, Agent, or Firm* — Dority & Manning, P.A.

(57) ABSTRACT

Dryer appliances are provided herein including a cabinet having a lower panel and a drum rotatably mounted within the cabinet. The drum defines a chamber for receipt of articles for drying. A drawer is removably mounted to the cabinet and includes a front wall, a rear wall, and sidewalls extended between the front wall and the rear wall. The drawer forms a lint collection bin. A filter assembly is removably positionable within the lint collection bin. The filter assembly abuts the lower panel of the cabinet when the drawer is in a closed position.

19 Claims, 7 Drawing Sheets

DRYER APPLIANCE AND FILTER APPARATUS

FIELD

The present subject matter relates generally to dryer appliances and filters for dryer appliances.

BACKGROUND

Dryer appliances are generally provided with a filter for collecting lint and other particles from air flowing through the dryer appliances. During a drying cycle, a large volume of lint can collect on the filter. Users of dryer appliances are normally instructed to clean the filter and remove collected lint from the filter between drying cycles. However, it can be difficult and/or inconvenient to frequently remove lint from the filter, and certain consumers forget to regularly clean the filter and/or disregard the cleaning instructions.

Lint disposed on the filter can restrict air flow through the dryer appliance and negatively affect performance of the dryer appliance. For example, restricted air flow through a drum of the dryer appliance can raise a temperature of air within the drum and damage clothing articles within the drum. As another example, a thermostat or other temperature regulating device of the dryer appliance may trip due to the increased temperature within the drum causing the drying cycle to be extended. Thus, an efficiency of the dryer appliance may be negatively affected when excessive lint is disposed on the dryer appliance's filter.

Accordingly, a dryer appliance with an improved filter apparatus would be useful.

BRIEF DESCRIPTION OF THE INVENTION

Aspects and advantages of the invention will be set forth in part in the following description, or may be obvious from the description, or may be learned through practice of the invention.

An aspect of the present disclosure is directed to a dryer appliance including a cabinet having a lower panel and a drum rotatably mounted within the cabinet. The drum defines a chamber for receipt of articles for drying. A drawer is removably mounted to the cabinet and includes a front wall, a rear wall, and sidewalls extended between the front wall and the rear wall. The drawer forms a lint collection bin. A filter assembly is removably positionable within the lint collection bin. The filter assembly abuts the lower panel of the cabinet when the drawer is in a closed position.

Another aspect of the present disclosure is directed to a dryer appliance including a cabinet having a lower panel, the cabinet housing a drum motor and a heater assembly. The cabinet includes a rail extending along a horizontal direction. A drum is rotatably mounted within the cabinet and forms a chamber for receipt of articles for drying. A drawer is slidable along the rail at the cabinet. The drawer includes a front wall, a rear wall, and sidewalls extended between the front wall and the rear wall. The drawer forms a lint collection bin. A filter assembly is removably positionable within the lint collection bin. The filter assembly abuts the lower panel of the cabinet when the drawer is in a closed position. A control panel is mounted on the cabinet and in communication with a controller configured to operate the drum motor and the heater assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
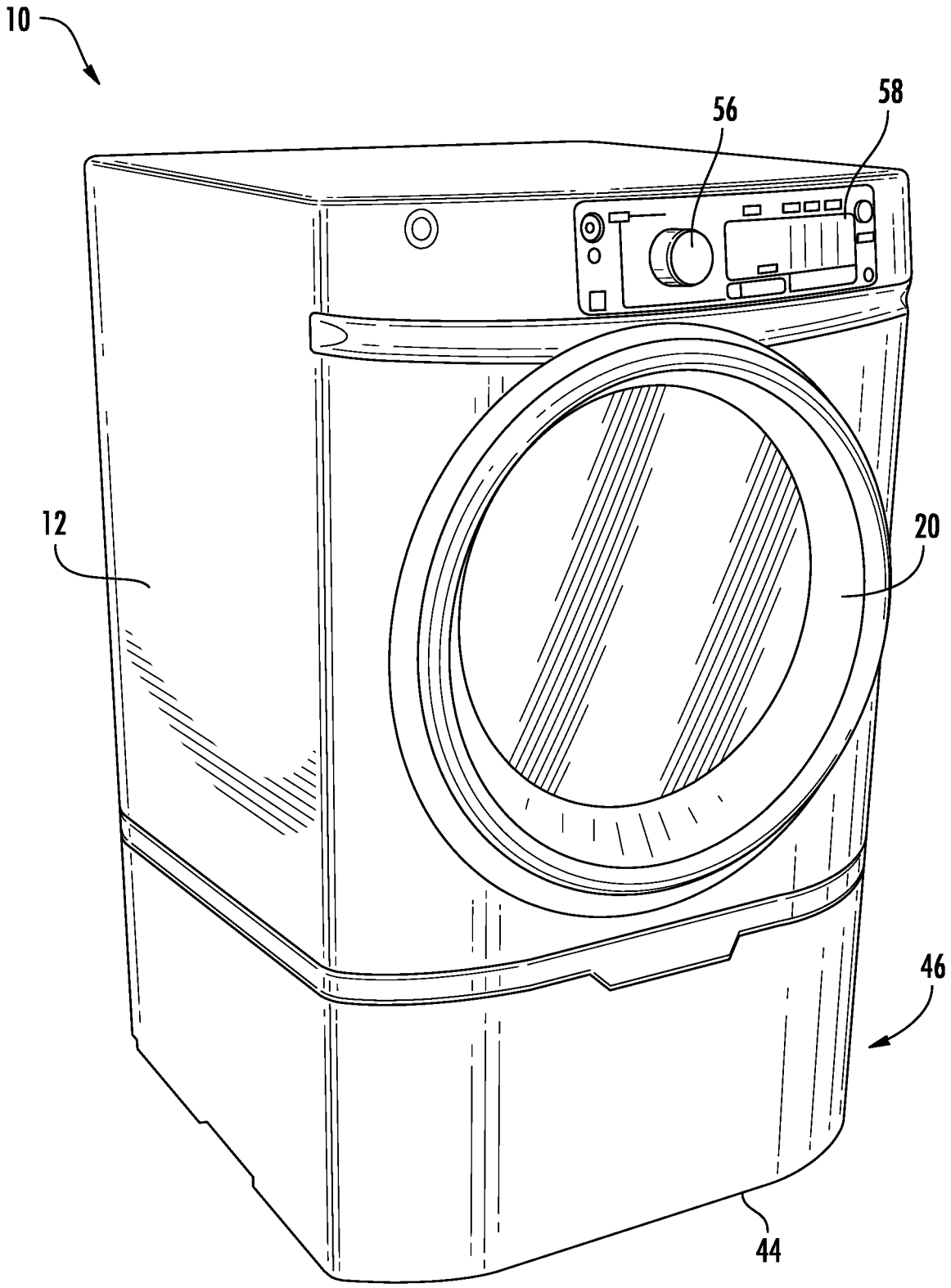
FIG. 1 is a perspective view of an embodiment of a dryer appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments of a dryer appliance are provided including a removable, disposable, or replaceable filter assembly positionable within a cabinet. The filter assembly may be formed substantially similarly as filters for heating, ventilation, and air conditioning (HVAC) systems. Embodiments of the appliance may allow for increased time between filter cleanings, changes, or replacements. The increased time may correspond to intervals generally provided by filters for HVAC systems, e.g., up to approximately six months, or up to approximately three months, or up to approximately one month. Particular embodiments of the appliance provided herein may be configured as residential dryer appliances.

Embodiments provided herein may decrease risks associated fire or other damage related to clogged or unclean filters. Embodiments provided herein may obviate a need for cleaning and removing lint from a filter per use (e.g., dryer load or cycle operation) by a user, or per day by a user. The appliance with filter assembly provided herein may improve user interaction by increasing the interval between filter cleanings or replacements, allowing for standard replaceable filters (e.g., HVAC filters) in place of custom-sized filters at a dryer appliance, and allowing for improved airflow through the dryer appliance through larger filter areas.

Figure 2:
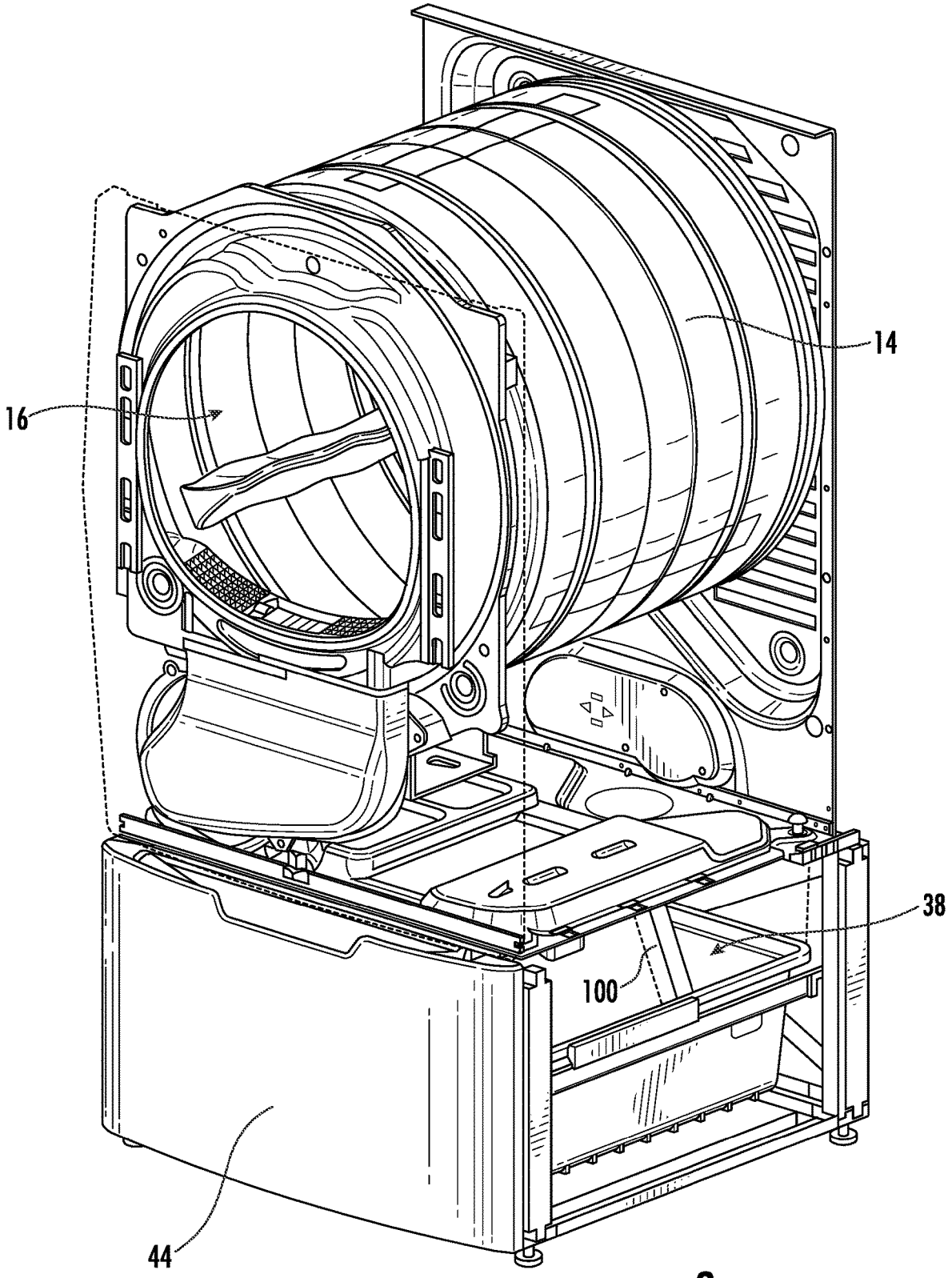
FIG. 2 is a partially see-through perspective view of an embodiment of the dryer appliance of FIG. 1 according to an exemplary embodiment of the present subject matter.

FIGS. 1 and 2 provide perspective views of a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is an electric dryer appliance with electric heating element for heating air. In alternative exemplary embodiments, dryer appliance 10 may be a gas dryer appliance with gas burners for heating air.

Dryer appliance 10 includes a cabinet 12. Within cabinet 12 is a drum or container 14 (FIG. 2) mounted for rotation about a substantially horizontal axis. Drum 14 is generally cylindrical in shape and defines a chamber 16 for receipt of articles for drying. Thus, clothing articles and other fabrics may be loaded into chamber 16 of drum 14 and dried therein, as discussed in greater detail below. A door 20 is rotatably mounted to cabinet 12 to permit selective access to chamber 16 of drum 14.

Figure 3:
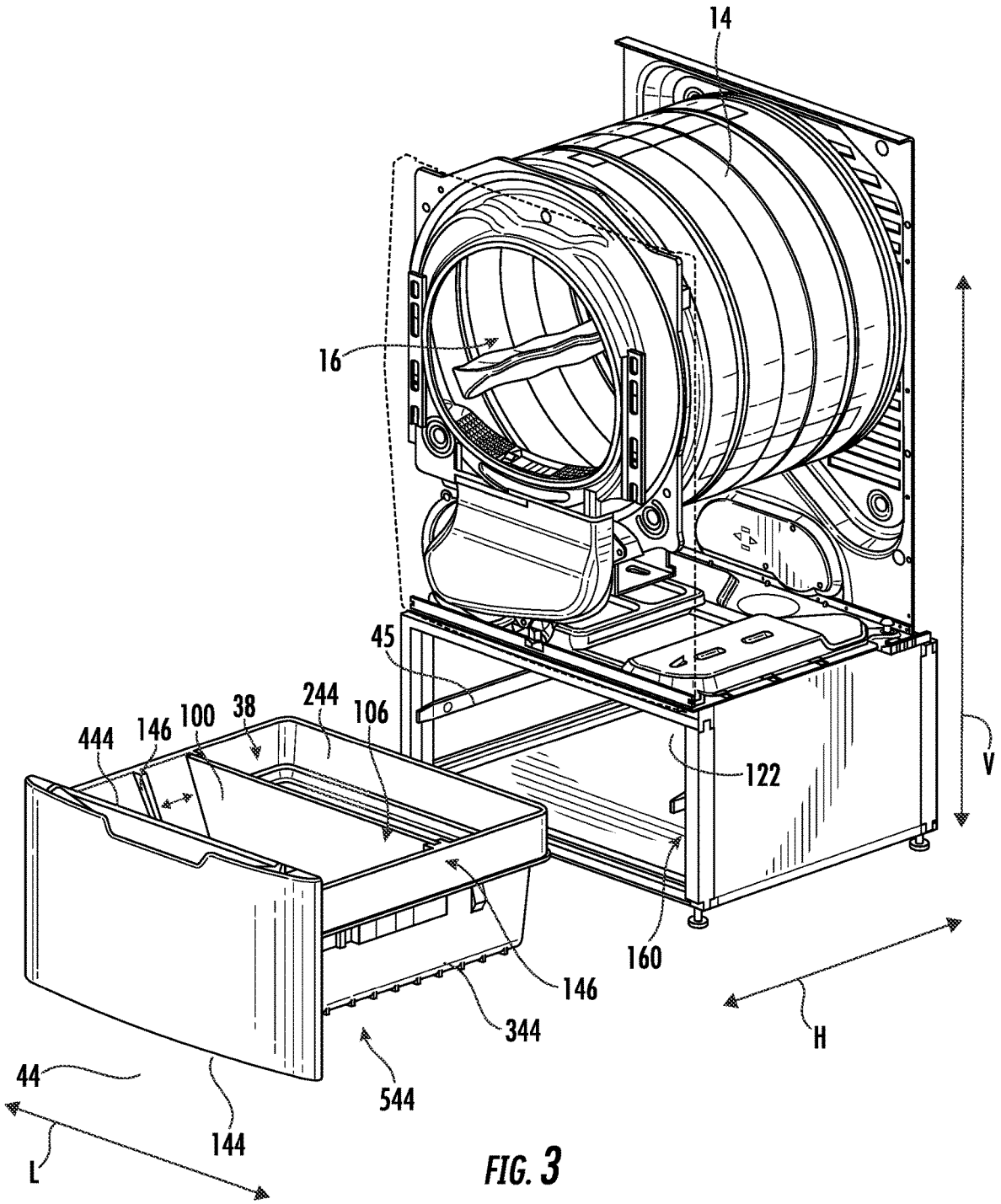
FIG. 3 is a partially see-through perspective view of an embodiment of the dryer appliance of FIGS. 1-2 with a drawer removed from the appliance, according to an exemplary embodiment of the present subject matter.

A drawer 44 is removably mounted to cabinet 12 at a bottom portion 46 of cabinet 12. Drawer 44 is adjustable (e.g., slidable) between a closed position (FIG. 1) and an open position (FIG. 3). In particular embodiments, the drawer 44 is slidable along a rail 45 extending within the cabinet 12 along a horizontal direction H. The drawer 44 includes front and rear walls 144, 244 and sidewalls 344, 444 extending between the front and rear walls 144, 244, together forming a lint collection bin 38. The rear wall 244 may form a vent opening 246 through which a flow of air may exhaust from the chamber 16 through the lint collection bin 38 and out of the appliance 10 through the vent opening 246. Lint collection bin 38 is configured for collecting and storing lint therein via a filter assembly 100, as discussed in greater detail below. The filter assembly 100 is removably positionable within the lint collection bin 38. The filter assembly 100 is configured to filter air flowing through dryer appliance 10, such as discussed further herein.

Referring to FIG. 3, the filter assembly 100 is positionable between the front and rear walls 144, 244 and the sidewalls 344, 444. A track 146 is formed at the sidewalls 344, 444 and extending substantially along a vertical direction V. In certain embodiments, the track 146 may extend along a lower wall 544 of the drawer 44. The track 146 forms a groove or slot through which the filter assembly 100 is selectively affixed within the drawer 44.

Figure 4:
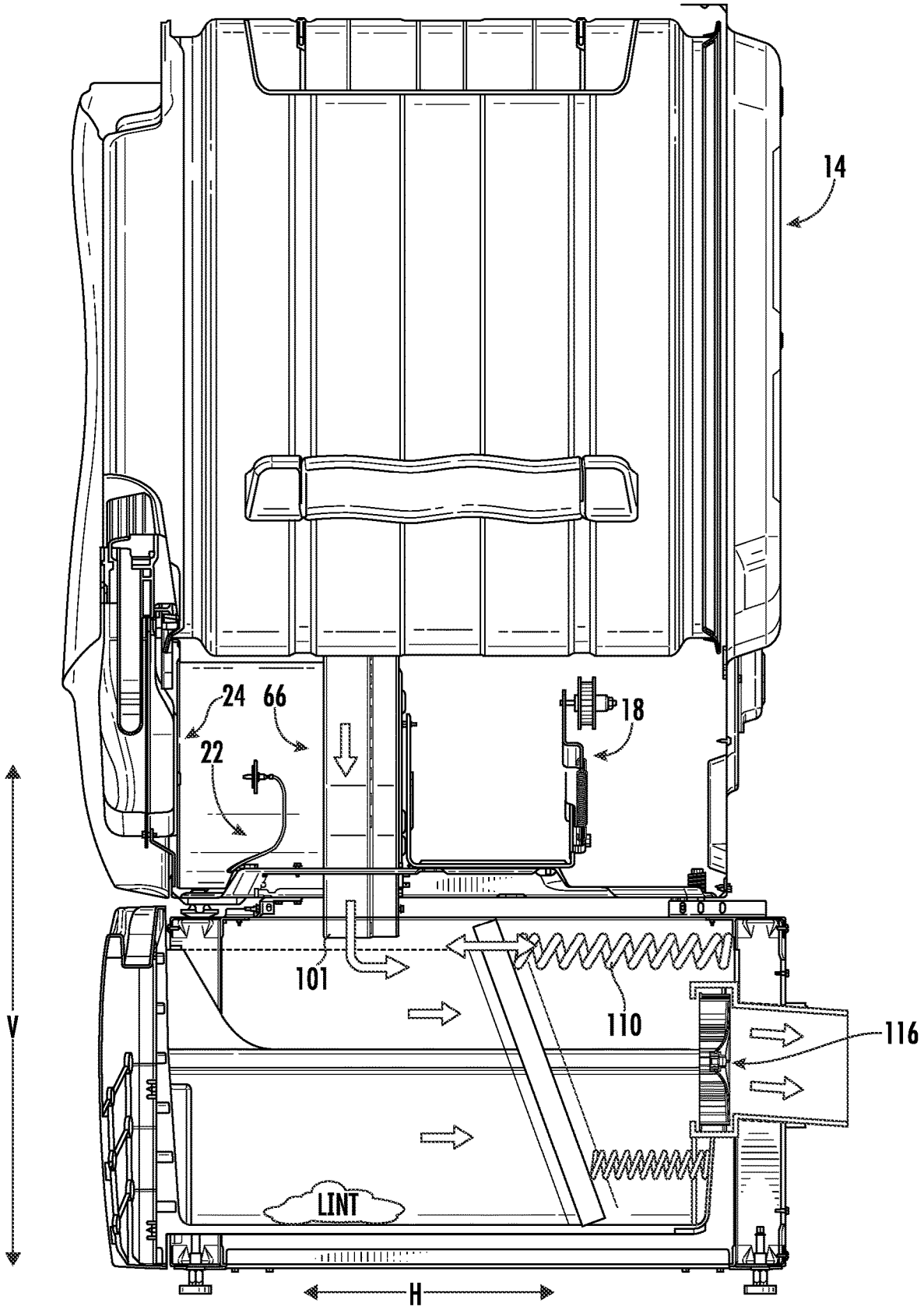
FIG. 4 is a side cross-sectional view of an embodiment of the dryer appliance according to an exemplary embodiment of the present subject matter.
Figure 5:
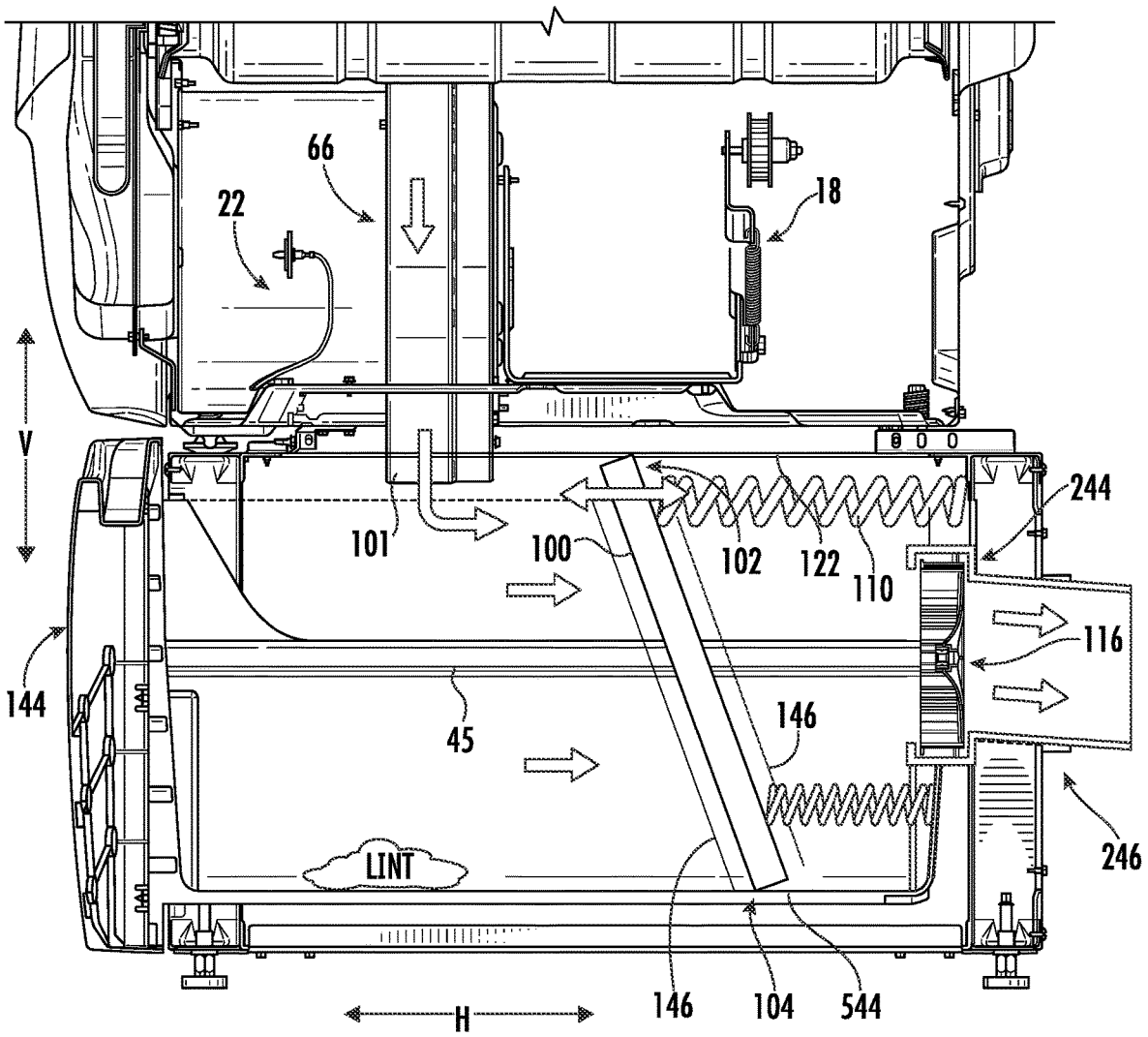
FIG. 5 is a side cross-sectional view of an embodiment of the dryer appliance according to an exemplary embodiment of the present subject matter.
Figure 6:
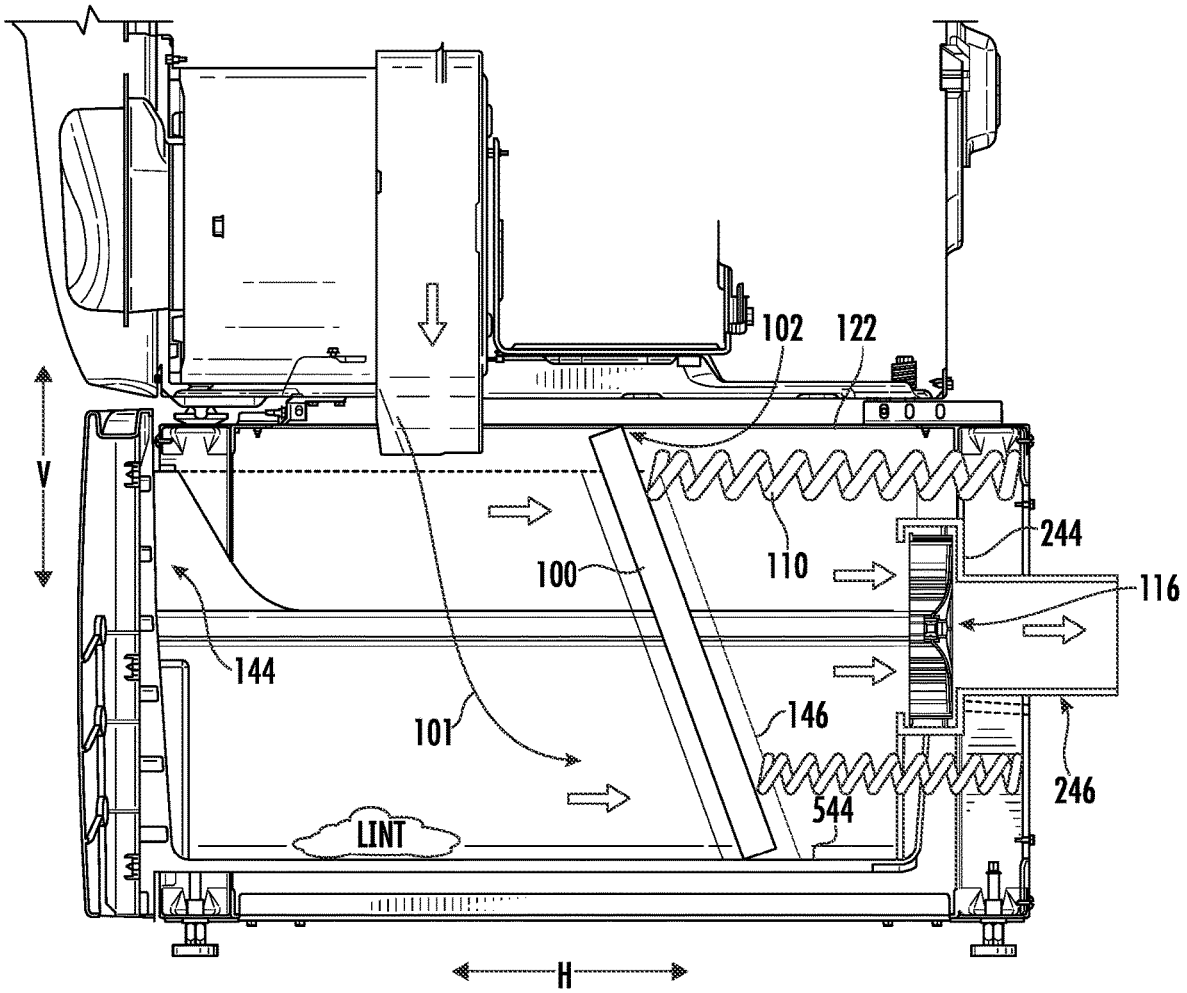
FIG. 6 is a side cross-sectional view of an embodiment of the dryer appliance according to an exemplary embodiment of the present subject matter.

Referring to FIGS. 4-6, the track 146 may extend at an angle relative to the horizontal direction H. In a particular embodiment, the track 146 is extends with an upper portion more proximate to the front wall 144 and a lower portion more proximate to the rear wall 244. When the filter assembly 100 is positioned in the drawer 44, an upper portion 102 of the filter assembly 100 is more proximate to the front wall 144 than a lower portion 104 of the filter assembly 100. In various embodiments, the angle is between approximately 45 degrees and up to approximately 90 degrees. In certain embodiments, the angle is greater than 55 degrees and less than 90 degrees. In still certain embodiments, the angle is greater than 60 degrees, or greater than 65 degrees, or greater than 70 degrees. When the filter assembly 100 is positioned in the drawer 44, the track 146 allows the filter to be disposed at the corresponding angle. When the drawer 44 with the filter assembly 100 is in the closed position, an upper portion 102 of the filter assembly 100 abuts a lower panel 122 of the cabinet 12. In a particular embodiments, the filter assembly 100 is in an interference fit or press-fit with a lower panel 122 of the cabinet 12. The lower panel 122 is extending along the horizontal direction from the front wall 144 to the rear wall 244 when the drawer 44 is in the closed position. Walls of the track 146 at which the filter assembly 100 is positioned provide sealing along a perimeter between the filter assembly 100 and the sidewalls 344, 444. The filter assembly 100 may furthermore be press-fit or interference fit with a lower wall 544 of the drawer 44. The track 146 and the fits at a lower portion 104 and upper portion 102 of the filter assembly 100 may together promote airflow through the filter and mitigate flow around the filter (e.g., between the filter assembly 100 and one or more sidewalls, lower panel, or lower wall).

Figure 7:
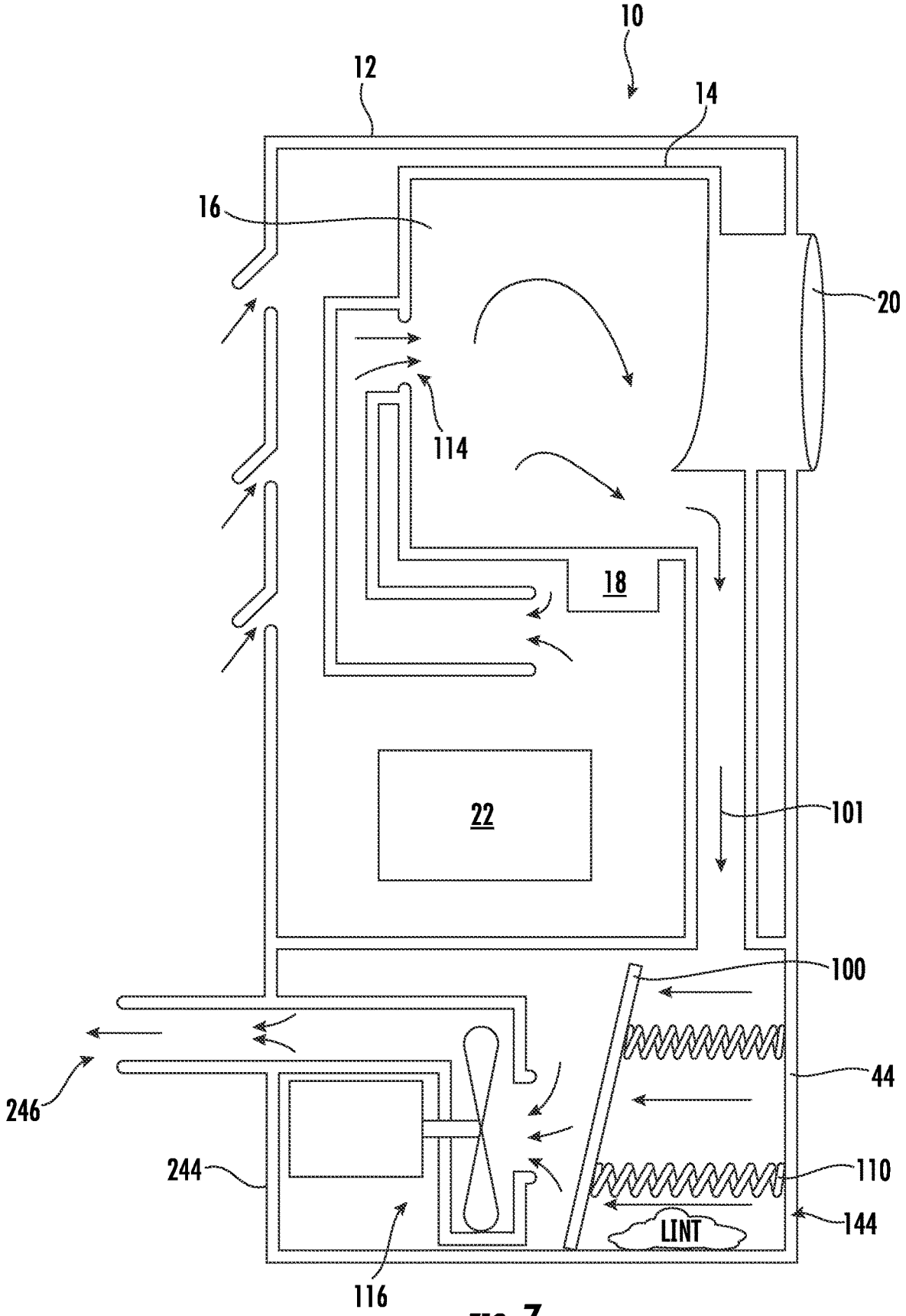
FIG. 7 is a schematic, side, cross-sectional view of an embodiment of the dryer appliance according to an exemplary embodiment of the present subject matter.

Referring now to FIG. 6, various embodiments of the appliance 10 include a spring 110 extending between the filter assembly 100 and the drawer 44 and configured to force the filter assembly 100 toward the flow of air 101 entering the lint collection bin 38 from the chamber 16. Certain embodiments of the appliance 10 include the spring 110 extending between the filter assembly 100 and the rear wall 244. The spring 110 may be configured to push the filter assembly 100 against the flow of air 101 entering the chamber 16 and passing across the filter assembly 100. The spring 110 may be configured as a compression spring. In other embodiments, such as depicted in FIG. 7, the spring 110 may extend between the filter assembly 100 and the front wall 144 be configured to pull the filter assembly 100 against the flow of air 101. The spring 110 may be configured as an extension spring extending from the front wall 144. In various embodiments, the spring 110 may promote sealing between the filter assembly 100 and the drawer 44. The spring 110 may particularly promote sealing between the filter assembly 100 and one or more of the track 146, the lower panel 122, or the lower wall 544 of the drawer 44.

A user of dryer appliance 10 may the filter assembly 100 from drawer 44 when drawer 44 is in the open position. With the filter assembly 100 removed from drawer 44, the user may clean or replace the filter assembly 100 and remove lint from within drawer 44. The user may adjust drawer 44 to return the filter assembly 100 to a suitable position for collecting lint during operation of dryer appliance 10. A poka-yoke arrangement between filter assembly 100 and drawer 44 may assist with insuring that filter assembly 100 is properly or suitably positioned within drawer 44 to capture lint during operation of dryer appliance 10.

Various embodiments of the filter assembly 100 include a filter element formed of any suitable filter material, including fiberglass, polyester, or cotton, or combinations thereof, suspended in a frame 106 (FIG. 3). The frame 106 may be formed of a paper-based material, cardboard, wire or wire-mesh material, metal or metallic material, rubber or synthetic rubber, or combinations thereof. The frame 106 may be configured to be deformable, such as to allow the filter assembly 100 to compress or fit against the lower panel 122, the track 146, and the lower wall 544 when the drawer 44 is in the closed position, such as to limit or eliminate a flow of air between one or more respective surfaces and the frame 106 and promote airflow through the filter element.

Embodiments of the appliance 10 provided herein may allow for air filters generally used for residential or commercial heating, ventilation, or air conditioning (HVAC)

systems to be used at the appliance 10. The drawer 44 may be sized to correspond to one or more standard air filter sizes for HVAC systems. Various embodiments of the track 146 may be formed to accept air filters of various dimensions. For instance, the track 146 and the drawer 44 may be configured to accept a filter assembly between approximately 12 inches to approximately 15 inches along the vertical direction V, and between approximately 17 inches to approximately 24 inches in a lateral direction L. The filter assembly 100 may include any appropriate area insertable within the tracks 146 and abutting at least the lower panel 122.

The track 146 may allow for overlap over a filter element of the filter assembly 100. For instance, the track 146 may allow for an approximately 13.5 inch vertical direction filter, and walls of the track 146 may allow for filters approximately 1.5 inches greater or lesser in the vertical direction. In another instance, the track 146 may allow for an approximately 22 inch lateral direction filter, and may allow for filters approximately 3 inches greater or less in the lateral direction. In such embodiments, the appliance may be configured to desirably operate with a 13 inch by 21.5 inch filter, a 14 inch by 25 inch filter, a 16 inch by 20 inch filter, a 16 inch by 25 inch filter, or other filter size that may be standard to HVAC systems. It should be appreciated that the appliance 10 may be configured for any appropriate combination of vertical direction and lateral direction, and the appliance 10 may be configured to accept any appropriate or desired filter assembly 100.

FIG. 4 provides a side view of certain components of dryer appliance 10. Dryer appliance 10 includes drum 14 rotatably mounted within cabinet 12. A rear wall of drum 14 may be rotatably supported within cabinet 12 by a suitable fixed bearing. A drum motor 18 rotates the drum 14 about a horizontal axis. For example, drum motor 18 may be coupled to drum 14 via a pulley and belt system or drum motor 18 may be directly coupled to drum 14 and directly drive drum 14. Drum motor 18 may also be in mechanical communication with an air handler 24 such that drum motor 18 rotates an impeller assembly (not shown) of air handler 24. Air handler 24 is configured for drawing air through chamber 16 of drum 14, e.g., in order to dry articles located therein as discussed in greater detail below. In alternative exemplary embodiments, dryer appliance 10 may include an additional motor (not shown) for operating air handler 24 independently of drum 14.

Drum 14 is configured to receive heated air that has been heated by a heater assembly 22, e.g., in order to dry damp articles disposed within chamber 16 of drum 14. During operation of dryer appliance 10, drum motor 18 rotates drum 14 and air handler 24 such that air handler 24 draws air through chamber 16 of drum 14. In particular, ambient air enters heater assembly 22 due to air handler 24 urging such ambient air into heater assembly 22. Ambient air is heated within heater assembly 22 and exits heater assembly 22 as heated air. Air handler 24 draws such heated air to drum 14. The heated air enters drum 14, e.g., through a plurality of holes 114 defined in drum 14.

Within chamber 16, the heated air accumulates moisture and lint, e.g., from damp articles disposed within chamber 16. In turn, air handler 24 draws lint and moisture laden air 101 from chamber 16 to a filter assembly 100 which traps lint and removes lint particles from the lint and moisture laden air. The lint may generally be captured at an upstream side of the filter assembly 100. The upstream side of the filter assembly 100 may generally be distal to a vent opening 246 formed through the rear wall 244 of the drawer 44. After filter assembly 100, moisture laden air passes out of clothes dryer 10 through the vent opening 246 through the rear wall 244 of the drawer 44 and through the cabinet 12.

Referring particularly to a schematic side view embodiment of a dryer appliance 10 depicted in FIG. 7, the appliance 10 may be configured such as described above with regard to FIG. 4. In the embodiment depicted in FIG. 7, an impeller assembly 116 is configured to pull the heated air from the chamber 16 and across the filter assembly 100. Embodiments of the appliance 10 including the filter assembly 100 such as described further herein may allow the impeller assembly 116 to be positioned at or next to the drawer 44. In a still particular embodiment, the appliance 10 including the filter assembly 100 such as described further herein may allow the impeller assembly 116 to be positioned downstream of the filter assembly 100, such as proximate to the filtered air that has passed through the filter assembly 100, or distal to the lint-laden air entering the filter assembly 100.

Turning back to FIG. 1, dryer appliance 10 includes a cycle selector knob 56 mounted on a cabinet control panel 58. Cycle selector knob 56 and other control inputs of cabinet control panel 58 are in communication with a controller. Signals generated in the controller operate a drum motor and heater assembly in response to a position of selector knob 56. Alternatively, a touch screen type interface may be provided. The controller may include a memory and one or more microprocessors, CPUs or the like, such as general or special purpose microprocessors operable to execute programming instructions or micro-control code associated with operation of dryer appliance 10. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller may be positioned in a variety of locations throughout dryer appliance 10. For example, the controller may be located at, adjacent to, or integral to cabinet control panel 58 in cabinet 12. In such an embodiment, input/output ("I/O") signals may be routed between controller and various operational components of dryer appliance 10. As an example, the various operational components of dryer appliance 10 may be in communication with controller via one or more signal lines or shared communication buses.

Referring back to FIG. 3, certain embodiments of the appliance 10 may include a position sensor 160 configured to detect whether the drawer 44 is in an open position (FIG. 3) or a closed position (FIGS. 4-6). In a particular embodiment, the position sensor 160 is positioned at the rail 45. The position sensor 160 may include any appropriate device for determining or measuring proximity or position. The position sensor 160 may form a switch determining whether a threshold hold has been met (e.g., closed or opened). Certain embodiments of the position sensor 160 may form a magneto-resistive device, an inductive device, a capacitive displacement device, a Hall effect device, or other appropriate type of switch or sensor. The position sensor 160 may furthermore form an electronic or mechanical lock configured to secure the drawer 44 to the bottom portion 46 of the cabinet 12.

Certain embodiments of the appliance 10 include the sensor 160 in operative or communicative coupling with the controller or control panel 58. The control panel 58 may be configured to receive a signal from the sensor 160 indicative of whether the drawer 44 is in an open position or a closed position. In particular embodiments, an open drawer signal from the sensor 160 received by the control panel 58 causes the control panel 58 to generate a fault signal. The fault signal may indicate to a user that the drawer 44 is open. Additionally, or alternatively, the fault signal may inhibit further operation of the appliance 10, such as inhibiting operation of the heater, fan, and/or drum. In still particular embodiments, a closed drawer signal from the sensor 160 received by the control panel 58 may cause the control panel 58 to allow operation of the heater, fan, and/or drum. Furthermore, the closed drawer signal from the sensor 160 may cause the sensor 160 to lock the drawer 44 to the cabinet 12. At the end of a cycle, or upon cancelation by a user or opening of the chamber 16, the control panel 58 may generate a signal allowing the sensor 160 to unlock the drawer 44 from the cabinet 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet comprising a lower panel;

a drawer removably mounted to the cabinet, the drawer comprising a front wall, a rear wall, and sidewalls extended between the front wall and the rear wall, the drawer forming a lint collection bin, the lower panel extending along a horizontal direction from the front wall to the rear wall of the drawer when in a closed position;

a filter assembly removably positionable within the lint collection bin, the filter assembly abutting the lower panel of the cabinet when the drawer is in the closed position, wherein the drawer comprises a track at which the filter assembly is removably positionable; and a spring extending between the filter assembly and the drawer, wherein the spring is configured to force the filter assembly toward a flow of air entering the lint collection bin.

2. The dryer appliance of claim 1, wherein the track extends at an angle between approximately 45 degrees and up to approximately 90 degrees.

3. The dryer appliance of claim 1, wherein the track extends at an angle, wherein an upper portion of the filter assembly is more proximate to the front wall of the drawer than a lower portion of the filter assembly when positioned in the drawer.

4. The dryer appliance of claim 1, wherein the track is positioned at one or more sidewalls of the drawer.

5. The dryer appliance of claim 1, wherein the track is configured for the filter assembly comprising a vertical direction between approximately 12 inches and approximately 15 inches.

6. The dryer appliance of claim 1, wherein the track is configured for the filter assembly comprising a lateral direction between approximately 19 inches and approximately 25 inches.

7. The dryer appliance of claim 1, wherein the filter assembly is press fit or interference fit with the lower panel of the cabinet when in the drawer is in the closed position, wherein the track and the press fit or interference fit with the lower panel promote airflow through a filter of the filter assembly and mitigate flow around the filter.

8. The dryer appliance of claim 1, wherein the spring extends from the rear wall of the drawer to the filter assembly.

9. The dryer appliance of claim 1, wherein the spring extends from the front wall of the drawer to the filter assembly.

10. The dryer appliance of claim 1, the cabinet comprising a rail extending along a horizontal direction, wherein the drawer is slidable along the rail, and wherein the filter assembly positioned at the lint collection bin formed at the drawer is slidable along the horizontal direction along which the rail extends.

11. A dryer appliance, comprising:

a cabinet comprising a rail extending along a horizontal direction and a lower panel;

a drawer slidable along the rail at the cabinet, the drawer comprising a front wall, a rear wall, and sidewalls extended between the front wall and the rear wall, the drawer forming a lint collection bin, the lower panel extending along a horizontal direction from the front wall to the rear wall of the drawer when in a closed position;

a filter assembly removably positionable within the lint collection bin, the filter assembly abutting the lower panel of the cabinet when the drawer is in the closed position;

a spring extending between the filter assembly and the drawer, wherein the spring is configured to force the filter assembly toward a flow of air entering the lint collection bin; and a control panel mounted on the cabinet, the control panel in communication with a controller and a position sensor positioned at the rail, the position sensor in operative communication with the control panel to receive a signal from the position sensor indicative of whether the drawer is in an open position or the closed position.

12. The dryer appliance of claim 11, the position sensor comprising a lock configured to secure the drawer to a bottom portion of the cabinet.

13. The dryer appliance of claim 11, the drawer comprising a track at which the filter assembly is removably positionable.

14. The dryer appliance of claim 13, wherein the track extends at an angle between approximately 45 degrees and up to approximately 90 degrees, and wherein an upper portion of the filter assembly is more proximate to the front wall of the drawer than a lower portion of the filter assembly when positioned in the drawer.

15. The dryer appliance of claim 14, wherein the track is positioned at one or more sidewalls of the drawer.

16. The dryer appliance of claim 11, wherein the rear wall forms a vent opening through which a flow of air exhausts from the lint collection bin.

17. The dryer appliance of claim 1, wherein the rear wall forms a vent opening through which a flow of air exhausts from the lint collection bin.

18. The dryer appliance of claim 10, comprising:

a control panel mounted on the cabinet, the control panel in communication with a controller and a position sensor positioned at the rail, the position sensor in operative communication with the control panel, the control panel configured to receive a signal from the position sensor indicative of whether the drawer is in an open position or the closed position.

19. The dryer appliance of claim 18, the position sensor comprising a lock configured to secure the drawer to a bottom portion of the cabinet.

* * * * *